United States Patent [19]

Bartholic

[11] 4,374,021

[45] Feb. 15, 1983

[54] METHOD FOR CONTROLLING A PRETREATMENT PROCESS

[75] Inventor: David B. Bartholic, Watchung, N.J.

[73] Assignee: Engelhard Minerals & Chemicals Corporation, Edison, N.J.

[21] Appl. No.: 225,927

[22] Filed: Jan. 19, 1981

[51] Int. Cl.[3] ..... C10G 25/09; C10G 25/12

[52] U.S. Cl. ..... 208/251 R; 208/91; 208/159; 208/299; 208/305; 252/419

[58] Field of Search ..... 208/91, 251 R, 299, 208/305; 252/419

[56] References Cited

U.S. PATENT DOCUMENTS

| | | | |
|---|---|---|---|
| 2,378,531 | 6/1945 | Becker | 208/91 |
| 2,462,891 | 3/1949 | Noll | 208/91 |
| 2,985,584 | 5/1961 | Rabo et al. | 252/419 |
| 4,115,250 | 9/1978 | Flanders et al. | 208/120 |
| 4,238,317 | 12/1980 | Vasalos et al. | 208/120 |
| 4,243,514 | 1/1981 | Bartholic | 208/251 R |
| 4,263,128 | 4/1981 | Bartholic | 208/251 R |
| 4,274,942 | 6/1981 | Bartholic et al. | 252/419 |
| 4,276,150 | 6/1981 | McHenry, Jr. | 252/419 |
| 4,280,898 | 7/1981 | Tatterson et al. | 208/119 |
| 4,299,687 | 11/1981 | Myers et al. | 208/120 |

*Primary Examiner*—Delbert E. Gantz
*Assistant Examiner*—O. Chaudhuri
*Attorney, Agent, or Firm*—Inez L. Moselle

[57] ABSTRACT

An improved process is provided for decarbonizing, demetallizing and/or desalting a hydrocarbon feed stock by: contacting, in a selective vaporization step, for a short hydrocarbon residence time at an elevated contact temperature, the feed stock with an inert solid contact material in a confined rising vertical column to vaporize a major portion of the feed stock and to provide, as combustible deposits on the contact material, an unvaporized minor portion of the feed stock which includes high Conradson Carbon components and/or metal-containing components of the feed stock; separating the vaporized major portion of the feed stock from the contact material bearing the combustible deposits; contacting in a combustion step the contact material, bearing the combustible deposits, with an oxidizing gas to oxidize the combustible deposits and generate heat, whereby the contact material is heated by combustion of the combustible deposits; and recycling the so-heated contact material to contact further feed stock in the selective vaporization step. The improvement in the process comprises:

contacting the contact material in the combustion step with less than the stoichiometric amount of oxidizing gas, required to oxidize completely the combustible deposits, so that oxidizable high Conradson Carbon and/or metal-containing components of the combustible deposits are only partially oxidized to carbon monoxide and so that there is a reducing atmosphere in the combustion step.

30 Claims, 2 Drawing Figures

METHOD FOR CONTROLLING A PRETREATMENT PROCESS

BACKGROUND OF THE INVENTION

This invention relates to a process for pretreating hydrocarbon feed stocks as described in my pending U.S. patent application, Ser. No. 90,247, filed Nov. 1, 1979, entitled "Upgrading Petroleum and Residual Fractions Thereof." This invention particularly relates to an improvement upon the method for controlling a process for pretreating hydrocarbon feed stocks as described in my pending U.S. patent application, Ser. No. 144,477, filed Apr. 28, 1980, entitled "Selective Vaporization Process And Dynamic Control Thereof."

In my pending application Ser. No. 90,247, a process is described for increasing the portion of heavy petroleum crudes which can be utilized as the hydrocarbon feed stocks for fluid catalytic cracking ("FCC") processes to produce premium petroleum products, particularly motor gasoline of high octane number or high quality heavy fuel. The heavy ends of many crudes are high in Conradson Carbon residues (sometimes reported as Ramsbottom Carbon residues) and metal values, such as nickel and vanadium, as well as salts, such as sodium salts, which are undesirable in FCC feed stocks and in products such as heavy fuel. The process of my application Ser. No. 90,247 provides an economically attractive method for selectively removing and utilizing these undesirable components from whole crudes, as well as from the bottom fractions or residues of atmospheric and vacuum distillations of whole crudes, commonly called atmospheric and vacuum residua or "resids". In this regard, terms such as "residual stocks" and "resids" are used in a somewhat broader sense than is usual to include any petroleum fraction remaining after fractional distillation of petroleum to remove some of its more volatile components. In that sense, "topped crude", remaining after distilling off gasoline and lighter fractions, is a resid. The undesirable high Conradson Carbon (low hydrogen content) compounds, such as polynuclear aromatic compounds, and metal-containing compounds, as well as salts, present in crudes (e.g., whole crudes or resids) tend to be concentrated in the resids because most of them have low volatility.

When first introduced to the petroleum industry in the 1930's, the FCC process constituted a major advance over previous processes for increasing the yield of motor gasoline from petroleum to meet ever increasing demands. The FCC process was adpated to produce abundant yields of high octane naphtha from petroleum fractions boiling above the gasoline range, upwards of about 400° F. Greatly improved FCC processes have since been developed by intensive research efforts, and plant capacity has expanded rapidly up to the present, so that the catalytic cracker is today the dominant unit or "workhorse" of a petroleum refinery.

As installed capacity of FCC processes has increased, there has been increasing pressure to charge, as feed stocks to FCC units, greater proportions of crudes. However, two major factors have opposed that pressure, namely, the Conradson Carbon residues and metal values in the crudes. As the Conradson Carbon residues and metal values have increased in crudes, charged to FCC processes, cpacity and efficiency of catalytic crackers have been adversely affected. Also, the quality of heavy fuels, such as Bunker Oil and heavy gas oil, produced by FCC processes, has also been adversely affected as it has become necessary to make these fuels from crudes of high Conradson Carbon residues and high metal values.

The effect of high Conradson Carbon residues in hydrocarbon feed stocks for FCC processes has been to increase the portion of the feed stocks converted to "coke" deposits on the FCC catalysts. As coke has built up on the FCC catalysts, the active surfaces of the catalysts have been masked and rendered inactive for the desired catalytic cracking. It has been conventional to burn off the inactivating coke with air to "regenerate" the active surfaces, after which the catalysts have been returned in cyclic fashion to the reaction stage for contact with, and cracking of, additional feed stocks. The heat generated in the regeneration stage has been recovered and used, at least in part, to supply the heat of vaporization of the feed stocks and the endothermic heat of the cracking reaction. The regeneration stage has operated under a maximum temperature limitation to avoid heat damage to the catalysts. Since the rate of coke burning is a function of temperature, it has followed that any regeneration stage has had a limit of coke which could be burned in unit time. As the Conradson Carbon residues in feed stocks have increased, coke burning capacity has become a bottle-neck which has forced a reduction in the rate of charging the feed stocks to FCC units. In addition, part of the feed stocks have inevitably had to be diverted to undesirable reaction products.

Metal values, such as nickel and vanadium, in hydrocarbon feed stocks for FCC processes have tended to catalyze the production of coke and hydrogen in FCC units. Such metals also have tended to be deposited on FCC catalysts, as the molecules in which they occur in the feed stocks are cracked, and to build up on the catalysts. This has further increased coke production with its accompanying problems. Excessive hydrogen production also has caused a bottle-neck problem in processing lighter ends of cracked products through fractionation equipment to separate valuable components, primarily propane, butane and the olefins of like carbon number. Hydrogen, being incondensible in the "gas plant", has occupied space as a gas in the compression and fractionation train and has tended to overload the system when excessive amounts are produced by high metal content catalysts. This has required a reduction in charge rates to maintain FCC units and their auxiliaries operative.

These problems have long been recognized in the art, and many ways have been proposed to remove the high Conradson Carbon and metal-containing components from hydrocarbon feed stocks, such as resids, before they are used in FCC processes. For example, the high Conradson Carbon and metal-containing components of resids have been thermally converted into large quantities of solid fuel, i.e., coke. Such processes have been termed "coking", and two types of coking are now practiced commercially. In delayed coking, the resids have been heated in a furnace and passed to large drums maintained at 780°-840° F. During the long residence time at such temperatures, the resids have been converted to coke, and distillate products have been taken off the top of the drum for recovery of "coker gasoline", "coker gas oil" and gas. The other coking process has employed a fluidized bed of small granules of coke at about 900°-1050° F. The resids have undergone conversion on the surface of the coke particles during a residence time on the order of 2 minutes, depositing additional coke on the surfaces of the coke particles in the fluidized bed. Coke particles have then been transferred to a bed fluidized by air to burn some of the coke at temperatures upwards of 1100° F., thereby heating the residual coke which has then been returned to the coking vessel for conversion of additional resid.

These coking processes have been known to reduce metal values and Conradson Carbon residues in resids but to leave the resids as inferior gas oils for charging to FCC units. The coking processes have induced extensive cracking of components in the resids which would otherwise have been valuable in FCC feed stocks. This has resulted in gasoline of lower octane number (from thermal cracking) than would have been obtained by subjecting the same components to FCC processes. The gas oils produced have been olefinic and contained significant amounts of diolefins which are prone to degradation to coke in furnace tubes and on FCC catalysts. Hence, it has often been desirable to treat the gas oils by expensive hydrogenation techniques before charging them to FCC units or blending with other fractions for fuels.

Feed stocks for FCC processes have also been prepared from resids by "deasphalting" in which an asphalt precipitant such as liquid propane has been mixed with the resids. Metal values and Conradon Carbon residues of the resids have been drastically reduced, but low yields of deasphalted oil have been obtained.

Solvent extractions and various other techniques have been proposed for preparation of FCC feed stocks from resids. Low temperature, liquid phase sorption on catalytically inert silica gel also has been proposed by Shuman and Brace, *Oil and Gas Journal,* page 113 Apr. 6, 1963). However, such processes have had very high energy costs and have only been useful where the asphalt by-products could be sold.

By the pretreatment process of my pending application Ser. No. 90,247, high Conradson Carbon and metal-containing components, as well as salts, can be economically removed from a hydrocarbon feed stock, containing the highest boiling components of a crude, before charging the feed stock to an FCC unit or a hydroprocessing unit. In this pretreatment process, the feed stock is subjected to a selective vaporization step in which there is a high temperature, short hydrocarbon residence time contact in a confined rising vertical column between the feed stock and a hot solid contact material. The contact material serves as a heat transfer medium and acceptor of unvaporized material from the feed stock. The contact material is essentially inert in the sense that it has low catalytic activity for inducing cracking of the feed stock. Preferably, the contact material has a much lower surface area relative to its weight than conventional FCC catalysts. During the selective vaporization step, most of the feed stock is vaporized by the high temperature contact with the contact material. However, the majority of the high Conradson Carbon and metal-containing components of the feed stock, as well as salts in the feed stock, are not vaporized by the high temperature contact with the contact material but are instead deposited on the surface of the contact material. The contact material, on which the unvaporized portions of the feed stock have been deposited, is then subjected to a combustion step in which the combustible portions of the deposits on the contact material are oxidized to generate heat which is imparted to the contact material. The so-heated contact material is then recycled and contacted with additional feed stock. By this process, the heat required for the selective vaporization step is generated by oxidation of the combustible deposits on the contact material, including the combustible high Conradson Carbon and metal-containing components of the feed stock.

By the method of my pending application Ser. No. 144,477 for controlling my pretreatment process, the selective vaporization step is carried out at about the minimum contact temperature which: (a) will vaporize most of the hydrocarbon feed stock and its diluents but not the majority (e.g., 60–80%) of its high Conradson Carbon components, its metal-containing components or its salts; and (b) will provide sufficient combustible deposits of unvaporized portions of the feed stock on the contact material to allow the combustion step to be carried out at a predetermined temperature. The predetermined temperature of the combustion step is preferably set at or near the maximum allowable temperature of the combustion step. This is usually governed by the metallurgical limits of the burner in which the combustion step is carried out. The rate of recycle from the combustion step to the selective vaporization step of the contact material, heated during the combustion step, is varied to maintain the selective vaporization step at the minimum contact temperature which will provide sufficient combustible deposits on the contact material to allow the combustion step to be carried out at its predetermined temperature.

However, it has been found that, in the selective vaporization step of the pretreatment process of my pending application Ser. Nos. 90,247 and 144,477, metals, such as nickel and vanadium, which are deposited, and build up, on the surface of the contact material in the selective vaporization step, have tended to combine chemically with the contact material during the combustion step of the process. This has made separation of such metals from the contact material difficult and has caused the contact to be degraded during processes, used to remove the metals from the contact material.

There has been a need, therefore, for a way of preventing metals, deposited on the contact material, from chemically combining with the contact material during the combustion step of the process.

SUMMARY OF THE INVENTION

In accordance with this invention, an improved process is provided for decarbonizing, demetallizing and/or desalting a hydrocarbon feed stock by: contacting, in a selective vaporization step, for a short hydrocarbon residence time at an elevated contact temperature, the feed stock with an inert solid contact material in a confined rising vertical column to vaporize a major portion of the feed stock and to provide, as combustible deposits on the contact material, an unvaporized minor portion of the feed stock which includes high Conradson Carbon and/or metal-containing components of the feed stock; separating the vaporized major portion of the feed stock from the contact material bearing the combustible deposits; contacting in a combustion step the contact material, bearing the combustible deposits, with an oxidizing gas to oxidize the combustible deposits and generate heat, whereby the contact material is heated by combustion of the combustible deposits; and recycling the so-heated contact material to contact further feed stock in the selective vaporization step. The improvement in the process comprises:

contacting the contact material in the combustion step with less than the stoichiometric amount of oxidizing gas, required to oxidize completely the combustible deposits, so that oxidizable high Conradson Carbon and/or metal-containing components of the combustible deposits are only partially oxidized to carbon monoxide and so that there is a reducing atmosphere in the combustion step.

By this process improvement, the combustion step can be carried out with little or no chemical bonding between the metal values of the combustible deposits and the contact material. This simplifies the subsequent removal of metals, such as nickel and vanadium, from the contact material and reduces the deterioration of the contact material during the removal of the metals.

Also by this process improvement, the selective vaporization step can be carried out with even less cracking of the feed stock to form hydrogen and superfluous coke deposits on the contact material than in the pretreatment process of my pending application Ser. Nos. 90,247 and 144,477. Carbonaceous deposits are formed on the contact material in the selective vaporization step, and at least a portion of such deposits is maintained on the surface of the contact material during the combustion step. The residual carbonaceous deposits, left on the contact material during the combustion step, serve to minimize cracking of the feed stock when the contact material is recycled to the selective vaporization step. The residual carbonaceous deposits cover metals on the surface of the contact material which could catalyze the cracking of hydrocarbons in the feed stock. As a result, the contact material can be made from solid materials which might otherwise be unsuitable in the pretreatment process of my pending application Ser. Nos. 90,247 and 144,477 because of their high metal content.

DETAILED DESCRIPTION OF THE PREFERRED EMBODIMENT

Figure 1:
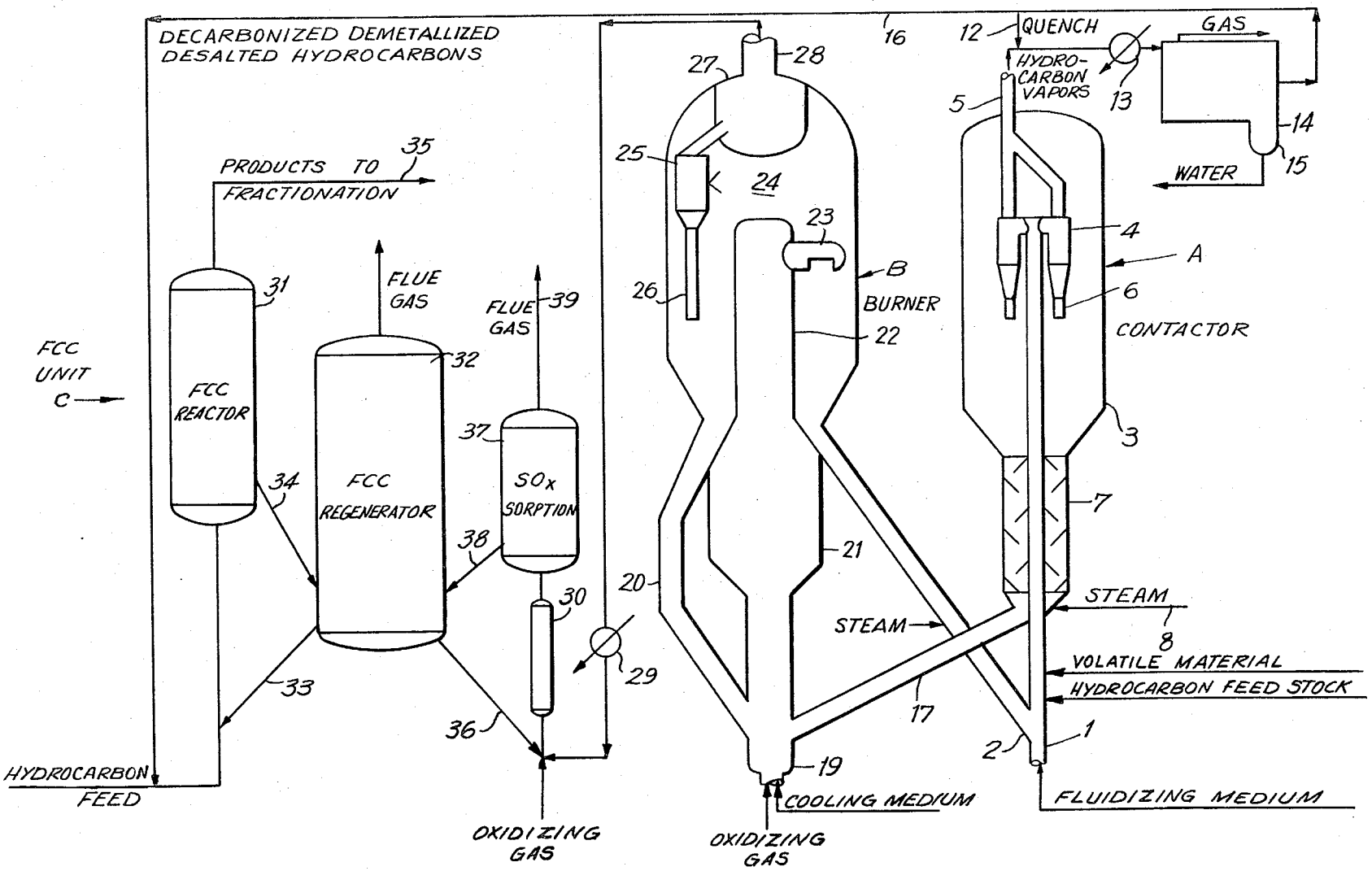
FIG. 1 is a schematic flow chart of the process of my pending application Ser. No. 90,247 for pretreating a hydrocarbon feed stock before subjecting the feed stock to an FCC process.

Shown in FIG. 1 are means for carrying out a pretreatment process as disclosed in my pending application Ser. No. 90,247 for decarbonizing, demetallizing and/or desalting a hydrocarbon feed stock, such as a whole crude or a resid. The means for carrying out the pretreatment process include a contactor, generally A, for carrying out a selective vaporization step and a burner, generally B, for carrying out a combustion step.

In the selective vaporization step, the hydrocarbon feed stock is mixed in a confined rising vertical column or riser 1 in the contactor A, shown in FIG. 1, with an inert solid fluidizable contact material. The contact material is supplied to the riser, heated to a high temperature. The contact material preferably has a lower surface area, relative to its weight, than conventional FCC catalysts. A particularly preferred contact material is a finely divided inert solid, such as microspheres of calcined kaolin clay having particle diameters in the range of about 20 to 150 microns.

During the selective vaporization step, hydrocarbons in the feed stock are vaporized by the high temperature contact with the contact material in the riser 1 of contactor A. There is also sorption of the high Conradson Carbon components, metal (particularly nickel and vanadium)containing components and salts (e.g., sodium salts) of the feed stock on the surface of the contact material. Also, carbonaceous deposits form on the surface of the contact material due to cracking of the feed stock, particularly its high Conradson Carbon and metal-containing components, deposited on the contact material.

At the top of the riser 1, after vaporization of most of the hydrocarbons in the feed stock and sorption of its high Conradson Carbon and metal-containing components and salts by the contact material, the vaporous hydrocarbons are rapidly separated from the contact material. Then, the hydrocarbon vapors are quenched as rapidly as possible to a temperature at which thermal cracking is essentially arrested.

The selective vaporization step involves very rapid vaporization and very short residence time of the hydrocarbon feed stock in the riser 1. This minimizes thermal cracking of the feed stock. The conventional method for calculating residence time in superficially similar FCC riser reactors is not well suited to the selective vaporization step. FCC residence times assume a large increase in number of mols of vapor as cracking proceeds up the length of the riser. Such effects are minimal in the selective vaporization step. Hence, for the selective vaporization step, hydrocarbon residence time (i.e., the time of contact between the feed stock and the contact material) is calculated as the length of the riser from the point where the feed stock and the contact material are initially mixed (i.e., at the injection point of the feed stock) to the point where the contact material is separated from the hydrocarbon vapors (i.e., at the top of the riser), divided by the superficial linear velocity at the separation point. As so measured, the hydrocarbon residence time for the selective vaporization step should be less than 3 seconds. Since some minor thermal cracking of the portions of the feed stock, deposited on the contact material, particularly the high Conradson Carbon and metal-containing components of the feed stock, will take place at the preferred selective vaporization temperatures, the selective vaporization step can be improved by reducing as much as possible the hydrocarbon residence time. Thus, if the equipment (e.g., the length of the riser 1 or the placement of multiple feed stock injection points along the riser 1) permits, a hydrocarbon residence time of less than 2 seconds is preferred, especially 0.5 second or less. The hydrocarbon residence time should, however, be long enough to provide adequate intimate contact between the feed stock and the contact material (e.g., at least 0.1 second).

As shown in FIG. 1, the contact material is introduced into the riser 1 at or near the bottom of the riser, preferably with a fluidizing medium, such as steam or water. The fluidizing medium transports the contact material up the riser 1 as the contact material heats the fluidizing medium. The feed stock is introduced at a point along the riser 1 which will insure a proper hydrocarbon residence time. The feed stock can be introduced into the riser 1 at the bottom of the riser or at one or more injection points along the riser. Preferably, a volatile material, such as steam, water or a hydrocarbon, is added to, and mixed with, the feed stock in the riser 1. The volatile material serves to control (i.e., to decrease) the hydrocarbon residence time and also to reduce the partial pressure of hydrocarbons in the feed stock. The volatile material can be introduced into the riser 1 at the bottom of the riser with the contact material or above the bottom of the riser, for example, with the feed stock or after the feed stock. When the volatile material is a hydrocarbon, it is preferably introduced into riser 1 with or after the feed stock to prevent cracking of the volatile material.

The feed stock can be preheated before it is introduced into the riser 1. The feed stock can be preheated to any temperature below thermal cracking temperatures, e.g., 200°–800° F., preferably 300°–700° F. Preheating temperatures higher than about 800° F. can induce thermal cracking of the feed stock with production of low octane naphtha.

The contact material is introduced into the riser 1 at a high temperature which is at least 1100° F. (up to about 1700° F.), preferably about 1300°–1400° F. The feed rate and the temperature of the contact material, introduced into the riser, are such that the resulting mixture of contact material and feed stock is at an elevated contact temperature which is upwards of 700° F. (up to about 1050° F.), preferably about 900°–1000° F. In this regard, the contact temperature of the mixture of feed stock and contact material should be high enough to vaporize most of the feed stock and its diluents (i.e., the fluidizing medium and the volatile material, if used). For a resid feed stock boiling above about 500°–650° F., a contact temperature of at least 900° F. will generally be sufficient. For a feed stock containing light ends, such as a whole crude or a topped crude, the contact temperature should be above the average boiling point of the feed stock as defined by Bland and Davidson, "Petroleum Processing Handbook" at page 14-4—that is, at a temperature above the sum of ASTM distillation temperatures from the 10 percent point to the 90 percent point, inclusive, divided by 9.

The pressure in the contactor A should, of course, be sufficient to overcome any pressure drops in the downstream equipment. In this regard, a pressure of 15–50 psi in the contactor A is generally sufficient.

During the very brief, high temperature contact of the contact material with the feed stock in the selective vaporization step, the majority of the heavy components of the feed stock having high Conradson Carbon residues and/or a metal content and salts in the feed stock are deposited on the contact material. This deposition may be a coalescing of liquid droplets, adsorption, condensation or some combination of these mechanisms on the particles of the contact material. In any event, there appears to be little or no conversion of a chemical nature. Particularly, thermal cracking is minimal and is primarily restricted to the portions of the feed stock, deposited on the contact material. What is removed from the feed stock by the contact material under preferred conditions is very nearly that indicated by the Conradson Carbon of the feed stock. Further, the hydrogen content of the deposits on the contact material is about 3–6%, below the 7–8% normal in FCC coke.

As seen from FIG. 1, the selective vaporization step is preferably carried out in an apparatus that is very similar in construction and operation to the vented riser reactors employed in modern FCC units. Typically, a feed stock, such as a vacuum resid boiling above 900° F. or an atmospheric resid containing components boiling as low as 500° F., is introduced into the riser 1 of the contactor A, for example, above the bottom of the riser 1. Hot contact material is introduced into the riser 1 at or near the bottom of the riser from a standpipe 2 from the burner B, used in the combustion step. Preferably, a fluidizing medium, such as steam or water, also is introduced into the riser at or near the bottom of the riser to carry the contact material up the riser. A volatile material, such as a hydrocarbon (preferably a light hydrocarbon, i.e., lighter than a resid), a steam or water which has been recycled in the pretreatment process, also is preferably introduced into the riser, with or after the feed stock, at a feed rate of the volatile material that is sufficient to decrease substantially the partial pressure of volatile hydrocarbon components of the feed stock.

The introduction of the volatile material and fluidizing medium into the riser 1 of the contactor A affects the temperature in the burner B, used in the combustion step. In this regard, part of the sensible heat of the contact material goes to heat and vaporize the added volatile material and fluidizing medium in the selective vaporization step. When the feed rate of volatile material and fluidizing medium is increased and/or the temperature of volatile material and fluidizing medium is decreased, this increases the rate at which contact material has to be introduced into the selective vaporization step to provide a desired contact temperature. This decreases the amount of combustible deposits per particle of contact material that can be oxidized in the burner, thereby reducing the temperature of the burner. Conversely, a reduction in the feed rate of volatile material and fluidizing medium and/or an increase in the temperature of volatile material and fluidizing medium will tend to increase burner temperature. It will be recognized that, at a constant feed rate of feed stock, variations in the feed rate of volatile material and fluidizing medium will also affect hydrocarbon residence time in the selective vaporization step.

The hot contact material and any fluidizing medium, introduced at the bottom of the riser 1 of contactor A, move upwardly in the riser at high velocity, e.g., 40 feet per second or more as measured at the top of the riser. The hot contact material mixes rapidly with the feed stock and any volatile material in the riser and carries the feed stock and volatile material up the riser at high velocity. The feed rate and temperature of the hot contact material, as well as the fluidizing medium and the volatile material, are such in the riser that the resulting mixture is at a suitable elevated temperature to volatilize all or most of the components of the feed stock except the majority of its high Conradson Carbon and metal-containing compounds and its salts.

Preferably the contact material is essentially inert in the sense that it induces minimal catalytic cracking of heavy hydrocarbons in the standard microactivity test. This test is conducted by measuring the amount of gas oil, converted to gas, gasoline and coke by contact with the contact material in a fixed bed. The charge in the test is 0.8 gram of mid-Continent gas oil of 27 API, contacted with 4 grams of contact material during 48 second oil delivery time at 910° F. and resulting in a ratio of contact material to oil of 5 at a weight hourly space velocity (WHSV) of 15. In the test, the contact material preferably exhibits a microactivity less than 20, especially about 10 or less. A preferred contact material is a finely divided inert solid, such as microspheres of calcined kaolin clay.

The microspheres of calcined kaolin clay, preferably used as the contact material in the pretreatment process of FIG. 1, are known in the art. For example, they have been employed as a chemical reactant with a sodium hydroxide solution in the manufacture of zeolitic FCC catalysts as described in Haden et al U.S. Pat. No. 3,647,718. In the pretreatment process of FIG. 1, however, the microspheres of calcined kaolin clay are not used as a chemical reactant. Thus, their chemical composition preferably corresponds to that of a dehydrated kaolin clay. Typically, the calcined kaolin clay microspheres analyze about 51–53 wt.% $SiO_2$, 41–45% $Al_2O_3$, and 0–1% $H_2O$, the balance being minor amounts of indigenous impurities, notably iron, titanium and alkaline earth metals. Generally, iron content (expressed as $Fe_2O_3$) is about ½–¾%, and titanium (expressed as $TiO_2$) is approximately 1.5–2%. However, in accordance with this invention, microspheres of kaolin clays having greater quantities of impurities, e.g., 2–9% $Fe_2O_3$, can also be suitably utilized—even though such clays might not ordinarily be suitable in the pretreatment process of my pending application Ser. No. 90,247 because their high metal content could cause dehydrogenation of a feed stock in the selective vaporization step.

The microspheres are preferably produced by spray drying an aqueous suspension of kaolin clay. The term "kaolin clay" as used herein embraces clays, the predominant mineral constituent of which is kaolinite, halloysite, nacrite, dickite, anauxite and mixtures thereof. Preferably a fine particle size plastic hydrated clay, i.e., a clay containing a substantial amount of submicron size particles, is used in order to produce microspheres having adequate mechanical strength. To facilitate spray drying, the powdered hydrated clay is preferably dispersed in water in the presence of a deflocculating agent, e.g., sodium silicate or a sodium condensed phosphate salt such as tetrasodium pyrophosphate. By employing a deflocculating agent, spray drying can be carried out at higher solids levels, and harder products are usually obtained. When a deflocculating agent is employed, slurries containing about 55–60% solids can be prepared, and these high solids slurries are preferred to the 40–50% slurries which do not contain a deflocculating agent.

Several procedures can be followed in mixing the ingredients to form the slurry, used in making the microspheres. One procedure is to dry blend the finely divided solids, add the water and then incorporate the deflocculating agent. The components can be mechanically worked together or individually to produce slurries of desired viscosity characteristics.

Spray dryers with countercurrent, cocurrent or mixed countercurrent and cocurrent flow of slurry and hot air can be employed to produce the microspheres. The air can be heated electrically or by other indirect means. Combustion gases, obtained by burning hydrocarbon fuel in air, can be used. When using a cocurrent dryer, air inlet temperatures up to about 1200° F. can be used when the clay feed is charged at a rate sufficient to produce an air outlet temperature within the range of 250°–600° F. At these temperatures, free moisture is removed from the slurry without removing water of hydration (water of crystallization) from the raw clay ingredient. Dehydration of some or all of the raw clay during spray drying is contemplated. The spray dryer discharge can be fractionated to recover microspheres of desired particle size. Particles having a diameter in the range of 20 to 150 microns are preferably recovered for calcination.

The calcination can be conducted in a manufacturing operation or by introducing the spray dried particles to the burner B, described below. While it is preferable in some cases to calcine the microspheres at temperatures in the range of about 1600°–2100° F. in order to produce particles of maximum hardness, it is possible to dehydrate the microspheres by calcination at lower temperatures, for example, temperatures in the range of 1000°–1600° F., thereby converting the clay into the material known as "metakaolin". After calcination the microspheres should be cooled and fractionated, if necessary, to recover the portion which is in the desired size range.

Pore volume of the microspheres of calcined clay will vary slightly with the calcination temperature and duration of calcination. Pore size distribution analysis of a representative sample obtained with a Desorpta analyzer using nitrogen desorption indicates that most of the pores have diameters in the range of 150–600 Angstrom units.

The surface area of the microspheres of calcined clay is relatively low and preferably within the range of 5–15 $m^2/g$ as measured by the well known B.E.T. method using nitrogen absorption. By comparison, the surface areas of commercial zeolitic FCC catalysts are considerably higher, generally exceeding values of 100 $m^2/g$ as measured by the B.E.T. method.

Other solid materials of low catalytic activity and of like particle size can be employed as the contact material in the pretreatment process of FIG. 1. In general, solids of low cost are recommended since it may be desirable to discard a sizeable portion of the contact material in the system from time to time and replace it with fresh contact material. Since the contact material is preferably of low porosity, resulting in deposition primarily on external surfaces, the contact material should be adapted to being abraded, e.g., in a column of air, to remove metal deposits on its surface.

At the top of the riser 1 in the contactor A, the vaporized hydrocarbons are separated as rapidly as possible from the entrained contact material on which the high Conradson Carbon and metal-containing components, as well as any salts, of the hydrocarbon feed stock are deposited. This can be accomplished by discharging the hydrocarbon vapors and the contact material from the riser 1 into a large disengaging zone defined by vessel 3. However, it is preferred that the riser discharge directly into cyclone separators 4. As is well known in the FCC art, a plurality of cyclones 4 can be utilized, and the cyclones can be single-stage or multi-stage units, with a gas phase from a first stage cyclone discharging to a second stage cyclone. Each cyclone 4 can be of the stripper cyclone type, described in Anderson et al U.S. Pat. No. 4,043,899 which is hereby incorporated by reference. From the cyclones 4, hydrocarbon vapors are transferred to vapor line 5, and contact material drops into the disengaging zone of vessel 3 by diplegs 6 and from there drops to stripper 7. In stripper 7, steam, admitted by line 8, displaces traces of volatile hydrocarbons from the contact material.

A particularly preferred apparatus (shown in FIG. 1) for separating hydrocarbon vapors from entrained contact material in the contactor A is the vented riser described in Meyers et al U.S. Pat. Nos. 4,066,533 and 4,070,159 which are hereby incorporated by reference. Such a vented riser can be used to effect substantial separation of hydrocarbon vapors from contact material at the top of the riser 1. Hydrocarbon vapors, along with any stripping steam from stripper 7 which passes through the open top of vented riser 1, are passed through cyclones 4 and then exit by way of vapor line 5 out of the contactor A. The majority of the contact material passes out of the vented riser 1 through the open top of the riser and combines in vessel 3 with any residual contact material, separated in cyclones 4.

The hydrocarbon vapors from vapor line 5 of the contactor A are mixed with cold liquid hydrocarbons introduced by line 12 to arrest thermal cracking. The so-quenched hydrocarbons are then cooled in condenser 13 and passed to accumulator 14 from which gases are removed for further processing or for fuel. Condenser 13 can be suitably utilized as a heat exchanger to preheat the hydrocarbon feed stock to the riser 1 or to preheat the decarbonized, demetallized, and/or desalted hydrocarbons that are in accumulator 14 and that are to be charged to an FCC unit, generally C, as shown in FIG. 1 and described below.

The quenching of the hydrocarbon vapors from vapor line 5 of the contactor A can be advantageously conducted in a column (not shown in FIG. 1) equipped with vapor-liquid contact zones, such as disc and doughnut trays or valve trays. Bottoms from such a column quencher could go directly to the FCC unit C, with the overhead passing to the condenser 13 and accumulator 14. In such a case, the riser 1 of the contactor A would also function as a preheat furnace for the decarbonized, demetallized and/or desalted hydrocarbons that are to be charged to the FCC unit C. This is of particular advantage when the hydrocarbon feed stock to the contactor A is a whole crude. The light hydrocarbons, present in the whole crude, can perform the same function as the volatile material when it is added to the hydrocarbon feed stock in the riser 1 of the contactor A, i.e., to decrease the partial pressure of the other hydrocarbon components of the feed stock. Preferably, any such column quencher is adapted to fractionate the hydrocarbon vapors from the contactor A into, for example: hydrocarbons which can be used as the volatile material, introduced into the riser 1; naphtha for reforming; kerosene; gas oil; and a heavy bottom to be charged to the FCC unit.

Water in accumulator 14 is preferably removed from sump 15 and introduced as the volatile material and/or as the fluidizing medium into the riser 1 of contactor A and/or introduced into the burner B for cooling the burner.

When water is introduced as the volatile material into the feed stock at the feed injection point of the riser 1 of the contactor A, the water is advantageously emulsified as the internal phase with the feed stock. When such emulsions are used, the water vaporizes with explosive force in riser 1 to aid in dispersion of the feed stock.

Certain advantages can be realized in the pretreatment process, shown in FIG. 1, when no fluidizing medium is introduced into the riser 1 of the contactor A by using recycled hydrocarbons (e.g., hydrocarbons obtained by fractionating the hydrocarbon vapors from the contactor A in the column quencher, mentioned above) instead of recycled water (e.g., water from sump 15) or steam as the volatile material, introduced into the riser 1. Using water or steam as the volatile material requires that the effluent of hydrocarbon vapors from the contactor A be cooled to the point of condensation of water, which in this water vapor/hydrocarbon vapor system is about 150° F. This results in relatively high losses in the valuable sensible heat and heat of condensation of the hydrocarbon vapors. When, however, recycled hydrocarbons are used as the volatile material, condensation of the effluent from the top of the riser can be accomplished at higher temperatures, resulting in much lower losses in the sensible heat and heat of condensation of the hydrocarbon vapors.

Hydrocarbons, to be used as the volatile material, introduced into the riser 1, should be chosen to boil below the contact temperature of the mixture of contact material and feed stock in the riser. Such hydrocarbons can be a gas fraction derived from the FCC unit C or a like hydrocarbon gas from other sources. Alternatively, the hydrocarbons can be naphtha, kerosene or gas oil. The hydrocarbons can come from external sources but preferably are derived from a recycle in the pretreatment process as described above.

The liquid hydrocarbons in accumulator 14 are desalted, decarbonized and/or demetallized hydrocarbons, such as a resid, and comprise a satisfactory charge for an FCC process or for a hydroprocess. Preferably, part of the liquid hydrocarbons in accumulator 14 are used as the cold quench liquid in line 12, and the balance is transferred directly to the FCC unit C by line 16.

As shown in FIG. 1, the contact material, bearing combustible deposits of high Conradson Carbon compounds and metal-containing compounds from the hydrocarbon feed stock, as well as combustible carbonaceous deposits, pass from the stripper 7 in the contactor A by a standpipe 17 to the inlet 19 at the bottom of the burner B, used in the combustion step of the pretreatment process. In the burner B, the contact material contacts an oxidizing gas, such as air or oxygen, preferably air. The combustion step can be carried out in the burner B using, for example, any of the techniques suited to the regeneration of an FCC catalyst. However, in accordance with this invention, the combustion step is carried out in the burner B with less than the stoichiometric amount of oxidizing gas, required to oxidize completely the combustible deposits on the contact material. As a result, a portion (e.g., 5–50%) of the combustible deposits are oxidized to carbon monoxide. Depending upon the feed rate of oxidizing gas supplied to the combustion step, a portion (e.g., 50–95%) of the combustible deposits will be oxidized to carbon dioxide. Combustion of the combustible deposits on the contact material to carbon monoxide and carbon dioxide generates the heat required for the selective vaporization step when heated contact material is returned by the standpipe 2 to the riser 1 in the contactor A and is mixed with hydrocarbon feed stock, fluidizing medium and volatile material.

The burner B can be similar in construction and operation to any of the known FCC regenerators. The burner can be of the riser type with hot recycle as shown in FIG. 1 or can be of the older, dense fluidized bed type. The burner can include any of the known expedients for adjusting burner temperature, such as nozzles for burning torch oil in the burner to raise temperature or heat exchangers to reduce temperature.

As shown in FIG. 1, contact material, with its combustible deposits, passes from the stripper 7 of the contactor A to the burner inlet 19 via standpipe 17. At the burner inlet 19, the contact material from standpipe 17 meets, and mixes with, a rising column of an oxidizing gas, preferably air, introduced into the burner inlet 19. Preferably, the contact material also meets, and mixes with, a cooling medium, such as steam or water, introduced into the burner inlet 19. The cooling medium serves to control (i.e., to decrease) the temperature of the burner B, as well as to help the oxidizing gas transport the contact material upwardly in the burner. At the burner inlet 19, the contact material from standpipe 17 also meets, and mixes with, hot contact material from burner recycle 20. The hot recycled contact material rapidly heats the fresh contact material, as well as the oxidizing gas and the cooling medium, to the 1100°-1500° F. temperature required for combustion of the deposits on the fresh contact material.

The oxidizing gas and cooling medium then carry the mixture of fresh and recycled contact materials upwardly from the burner inlet 19 to an enlarged zone 21 in the burner where the contact material forms a small fluidized bed in which thorough mixing and initial burning of the combustible deposits on the fresh contact material occur. The oxidizing gas and cooling medium then carry the burning mass of contact material further upward, through a restricted riser 22 to discharge at 23 into an enlarged disengaging zone 24. The hot burned particles of contact material fall to the bottom of the disengaging zone 24. A part of the hot contact material enters recycle 20, and another part enters the standpipe 2 for recycle to the riser 1 after steam stripping.

In accordance with this invention, the gaseous products of combustion in the burner B contain carbon monoxide, some residual oxygen, water vapor, nitrogen, oxides of sulfur ($SO_x$), oxides of nitrogen and carbon dioxide. Such gaseous products enter a cyclone 25 (one of a plurality of such devices) to disengage entrained contact material for discharge by dipleg 26. The clarified gases then pass to a plenum 27 from which flue gas is removed by burner outlet 28. The flue gas is cooled in a heat exchanger 29, contacted with additional oxidizing gas (e.g., air) in a riser reactor 30 to oxidize its sulfur compounds and its carbon monoxide, and contacted with an $SO_x$ type FCC catalyst to remove the oxides of sulfur from the flue gas. Thereafter, some of the heat value in the flue gas from the combustion of its carbon monoxide and sulfur compounds can be recovered as described below.

The pretreatment process, shown in FIG. 1, affords a control aspect not available in FCC units, i.e., controlling the temperature of the burner by: (a) varying the feed rate and temperature of volatile material (e.g., a hydrocarbon, water or steam) and/or fluidizing medium (e.g., water or steam) introduced into the riser 1 of the contactor A; and/or (b) varying the feed rate and temperature of cooling medium (e.g., water or steam) introduced into the burner B. For example, the burner temperature can be reduced by: (a) increasing the feed rate, and/or decreasing the temperature, of volatile material introduced into the riser 1 of the contactor A; (b) increasing the feed rate, and/or decreasing the temperature, of fluidizing medium introduced into the riser; and/or (c) increasing the feed rate, and/or decreasing the temperature, of cooling medium introduced into the burner B.

After the pretreatment of the hydrocarbon feed stock, the resulting decarbonized, desalted and/or demetallized hydrocarbons comprise a good quality feed stock for the FCC unit, generally C. Hence, as shown in FIG. 1, the hydrocarbons are transferred from the accumulator 14 by line 16 to an FCC reactor 31 operated in a conventional manner. Hot regenerated catalyst is transferred from an FCC regenerator 32 by a standpipe 33 for addition to the reactor charge. Spent catalyst from FCC reactor 31 passes by a standpipe 34 to the regenerator 32, while cracked products leave reactor 31 by transfer line 35 to fractionation for recovery of gasoline and other products.

Many hydrocarbon feed stocks, particularly resids, are high in sulfur content. Their sulfur is oxidized to sulfur oxides ($SO_x$) in the burner B in the riser reactor 30. In a preferred embodiment of the invention, the FCC reactor 31 operates on a catalyst designed for reduction of $SO_x$ emissions. Several such catalysts are known in the art. Such catalysts will absorb $SO_x$ in the oxidizing environment of the FCC regenerator 32. Catalyst which contains sorbed sulfur is then transferred to the reducing atmosphere of the FCC reactor 31. In that reducing atmosphere and in the presence of water, the sulfur is converted to hydrogen sulfide, which can be readily removed from FCC reactor products in the usual gas plant and treating facilities of a refinery. See Belgian Pat. Nos. 849,635, 849,636 and 849,637.

As shown in FIG. 1, a drag stream of catalyst from regenerator 32 is passed by standpipe 36 to mix with cooled flue gas passed from the burner B through heat exchanger 29. The mixture is then transferred, along with additional oxidizing gas, to the riser reactor 30 and then to a contactor 37 in which there is sorption on the FCC catalyst of $SO_x$ in the flue gas from the burner B. Catalyst carrying sorbed (reacted) $SO_x$ is conveyed by a standpipe 38 back to the FCC regenerator 32 for ultimate reaction in the FCC reactor 31. After cyclonic separation of entrained FCC catalyst, flue gas from which $SO_x$ has been so removed is then discharged by line 39 for recovery of the heat energy contained therein as by expansion turbines driving air blowers for regenerator 32 and burner B and/or by waste heat boilers or the like.

Control of temperature in the pretreatment process of FIG. 1 is a significant factor in achieving best results. In an FCC process, it is desirable to operate at the highest FCC reactor temperature consistent with equipment limitations and other constraints in order to produce gasoline of maximum research octane number. In the pretreatment process of FIG. 1, relatively low contact temperatures are preferred in the riser 1 of the contactor A for the selective vaporization step. Relatively low contact temperatures minimize thermal cracking of hydrocarbon feed stocks. Hence, the contact temperature in the riser 1 of the contactor A should be the minimum suitable contact temperature, preferably about 900°-1000° F., which: (a) will vaporize most of the hydrocarbon feed stock but not the majority of its high Conradson Carbon components, metal-containing components and salts; and (b) will sustain the heat balance relationship with the burner B.

The heat balance relationship between the riser 1 of the contactor A and the burner B is such in the pretreatment process of FIG. 1 that the temperature in the burner is a function of the quantity of combustible deposits from the feed stock on the contact material, going to the burner from the riser. The quantity of combustible deposits on the contact material is a function of the contact temperature in the riser. The contact temperature in the riser is a function of the temperature and feed rate of the contact material, recycled to the riser from the burner. The temperature of the recycled contact material is a function of the temperature in the burner.

Hence, as the contact temperature in the riser is decreased, less of the hydrocarbon feed stock is thermally cracked, but also, less of the feed stock is vaporized and more is deposited on the contact material; the increased combustible deposits on the contact material, going to the burner, can increase the temperature of the burner and of the contact material therein if there is increased oxidation of combustible deposits; and the decreased contact temperature in the riser can be maintained by decreasing the feed rate of contact material to the riser from the burner. Conversely, as the contact temperature in the riser is increased, more of the feed stock is thermally cracked, but also, more feed stock is vaporized and less is deposited on the contact material; the decreased combustible deposits on the contact material, going to the burner, can decrease the temperature of the burner and the temperature of the contact material therein if there is decreased oxidation of combustible deposits; and the increased contact temperature in the riser can be maintained by increasing the feed rate of contact material to the riser from the burner.

Also in the pretreatment process of FIG. 1, the higher temperatures of the operative range are preferred in the burner B for the combustion step. In this regard, the burner B is preferably operated at a predetermined temperature which is the maximum temperature which can be utilized without risk of heat damage to the materials, used in the burner's construction. Typically, this predetermined maximum temperature of the burner will be about 1200°–1500° F. By operating the burner at its predetermined maximum temperature, the heat output from the oxidization of combustible deposits on the contact material is maximized, even though the combustible deposits on the contact material are oxidized only partially to carbon monoxide in accordance with this invention.

Figure 2:
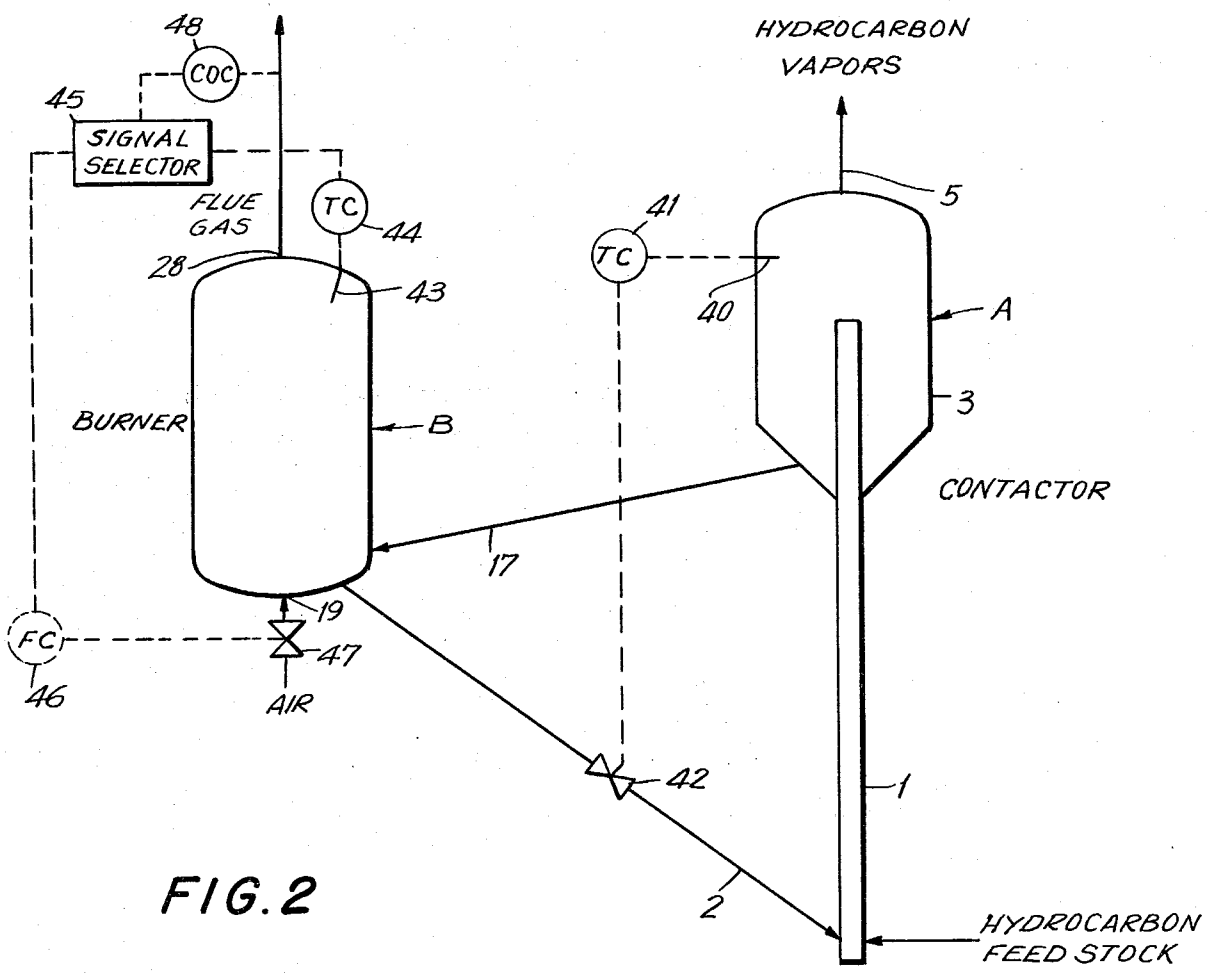
FIG. 2 is a schematic flow chart of the improved pretreatment process of this invention, wherein the contact material, from the selective vaporization step of the process of FIG. 1, is contacted with an oxidizing gas in the combustion step of the process to oxidize only partially combustible deposits on the contact material to carbon monoxide before the contact material is recycled to the selective vaporization step.

Schematically shown in FIG. 2 are means for controlling the pretreatment process of FIG. 1 in accordance with this invention. The control means, shown in FIG. 2, are adapted to maintain the contact temperature in the riser 1 of the contactor A at a minimum which: (a) will vaporize most of a hydrocarbon feed stock but not its high Conradson Carbon components, metal-containing components and salts; and (b) will sustain the heat balance relationship with the burner B. The control means of FIG. 2 are also adapted to maintain the feed rate of oxidizing gas, introduced into the burner B, at a level that: (a) provides less than the stoichiometric amount of oxidizing gas, required to oxidize completely the combustible deposits on the contact material from the feed stock, so that a portion of the deposits is oxidized to carbon monoxide and so that the gases in the burner comprise a reducing atmosphere; but (b) is as great as possible in order to maximize the temperature in, and the heat output from, the burner without allowing the temperature in the burner to exceed its predetermined maximum.

Preferably, the reducing atmosphere of this invention in the burner B contains about 0.1–10% (by volume on a dry basis) carbon monoxide, preferably about 2–8% carbon monoxide, as determined from the flue gas from the burner outlet 28. The remainder of the reducing atmosphere in the burner can contain carbon dioxide, water vapor, nitrogen, argon, unburned light hydrocarbons vapors, oxides of nitrogen, and oxides of sulfur but little or no, preferably less than 0.1%, oxygen.

By providing such a reducing atmosphere in the burner B in accordance with this invention, metals, such as nickel and vanadium, deposited on the contact material, do not significantly combine chemically with the contact material during the oxidation of the deposits on the contact material in the combustion step. In this regard, deposited metals are not oxidized appreciably but instead are reduced to an elemental state in the combustion step. Hence, deposited metals can be easily removed from the surface of the contact material by chemical or physical means, and the contact material is not likely to be harmed in the process of removing the deposited metals. In this regard, each metal on the surface of the contact material can be suitably removed with a conventional reagent which will selectively dissolve or vaporize that metal without attacking the underlying contact material.

Further by this invention, carbonaceous deposits, formed on the surface of the contact material during the selective vaporization step, are not completely removed during the combustion step. As a result, residual carbonaceous deposits are left on the contact material after the combustion step and are recycled to the selective vaporization step. Such residual carbonaceous deposits comprise about 0.05% by weight or more (e.g., up to 50%), preferably about 0.1–5%, of the contact material. These residual carbonaceous deposits are believed to result from the dehydrogenation of high Conradson Carbon components of the feed stock. During the selective vaporization step, the residual carbonaceous deposits on the contact material reduce cracking of hydrocarbon feed stocks to hydrogen and superfluous coke deposits on the contact material. It is believed that the residual carbonaceous deposits tend to cover any metals on the surface of the contact material, including metals such as nickel and vanadium, deposited on the contact material during the selective vaporization step. Such metal deposits, if they were not covered by the carbonaceous deposits, could serve as catalysts to promote the dehydrogenation of additional hydrocarbons in the feed stock during the selective vaporization step. By maintaining carbon monoxide and a reducing atmosphere in the burner B, sufficient residual carbonaceous deposits can be maintained on the contact material to cover metal within, or deposited on, the surface of the contact material and thereby to reduce substantially cracking of the feed stock during the selective vaporization step. This makes it possible to utilize materials as the contact material which might otherwise be unsuitable because of their high metal (e.g., iron) content.

Means for controlling the pretreatment process in accordance with this invention, as shown in FIG. 2, can comprise a first temperature sensor 40, such as a thermocouple, provided in the contactor A adjacent to the top of the riser 1. The first temperature sensor 40 is connected to a first temperature controller ("TC") 41 which activates a first valve 42 in the standpipe 2 by which hot contact material is recycled from burner B to the riser 1 of the contactor A. As in my pending application Ser. No. 144,477, the first valve 42 regulates the feed rate of hot contact material to the riser from the burner depending upon the contact temperature to be provided in the riser.

Means for controlling the pretreatment process in accordance with this invention also can comprise a second temperature sensor 43, provided in the burner B. The second temperature sensor 43 is connected to a second temperature controller 44 which is connected to a signal selector 45. The signal selector 45 is connected to a flow controller ("FC") 46 which is connected to a second valve 47 that controls the flow of oxidizing gas, preferably air, into the burner inlet 19. Connected to the burner outlet 28 is a sensor (not shown) for measuring carbon monoxide in the flue gas from the burner B. The carbon monoxide sensor is connected to a carbon monoxide controller ("COC") 48 which is also connected to the signal selector 45. The signal selector 45 is adapted to transmit a signal to the flow controller 46 from either the second temperature controller 44 or the carbon monoxide controller 48 depending upon which of them, if either, is signaling the flow controller 46 to reduce the feed rate of oxidizing gas to the burner. If neither the second temperature controller 44 nor the carbon monoxide controller 48 is signaling to reduce the feed rate of oxidizing gas to the burner but either the second temperature controller 44 or the carbon monoxide controller 48 is signaling to increase the feed rate of oxidizing gas to the burner, then the signal selector 45 will transmit the signal of either the second temperature controller or the carbon monoxide controller to the flow controller 46 to increase the feed rate of oxidizing gas through the second valve 47 to the burner.

The second temperature controller 44 is preferably adapted to signal the flow controller 46 to decrease or increase the flow of oxidizing gas through the second valve 47 to the burner B to keep the temperature of the burner at its predetermined maximum (e.g., 1400° F.). The carbon monoxide controller 48, on the other hand, is preferably adapted to signal the flow controller 46 to decrease the flow of oxidizing gas to the burner if the carbon monoxide in the burner goes below about 0.1%, preferably below about 2%, and to increase the flow of oxidizing gas to the burner if the carbon monoxide in the burner goes above about 10%, preferably above about 8%.

In the control means shown in FIG. 2, the temperature controllers 41 and 44, the carbon monoxide controller 48, the flow controller 46 and the signal selector 45 can, if desired, be designed for manual operation or for automatic operation. Preferably, the first temperature controller 41, the second temperature controller 44, the carbon monoxide controller 48, the flow controller 46 and the signal selector 45 are designed for automatic operation. However, the selection of devices to achieve either manual or automatic control of the pretreatment process of FIG. 1 is not critical, and conventional devices can be selected to perform such control functions.

The pretreatment process of FIGS. 1 and 2 can be controlled in accordance with this invention in a manner that will now be described. Initially, the process can have: a first contact temperature (e.g., 930° F.) within the range of suitable minimum contact temperatures (preferably about 900°-1000° F.) in the riser 1 of contactor A; the burner B with its predetermined maximum temperature (e.g., 1400° F.); and a first feed rate (e.g., 7 units/minute) of air, as the oxidizing gas, being supplied to the burner to provide a first concentration (e.g., 5%) of carbon monoxide in the burner gases as determined from the flue gas from the burner outlet 28.

In operation of the process, if the hydrocarbon feed stock becomes heavier, so that it contains greater amounts of high Conradson Carbon components and/or metal-containing components, and thereby the combustible deposits from the feed stock increase on the contact material, going from the contactor A to the burner B, the process can be controlled by maintaining: the first contact temperature (e.g., 930° F.) in the riser 1; the predetermined maximum temperature (e.g., 1400° F.) in the burner; and the first feed rate (e.g., 7 units/minute) of air to the burner—provided the carbon monoxide concentration in the burner gases does not go above about 10% (preferably above about 8%). If the carbon monoxide concentration in the burner gases goes above about 10% (preferably above about 8%), the contact temperature in the riser could be increased to a higher second temperature (e.g., 940° F.) within the range of suitable minimum contact temperatures. The contact temperature could be increased in accordance with my pending application Ser. No. 144,477 by increasing the feed rate of heated contact material to the riser from the burner through the standpipe 2 and the first valve 42. Also, the feed rate could be increased of volatile material and/or fluidizing medium (e.g., steam), introduced into the riser 1 of the contactor A. These measures would reduce the combustible deposits on the contact material in the riser, going to the burner, and thereby, these measures would reduce the carbon monoxide in the burner gases to less than about 10% (preferably less than about 8%). One could not simply increase the feed rate of air to the burner through the second valve 47 to reduce carbon monoxide in the burner gases because this would raise the burner temperature above its predetermined maximum (e.g., 1400° F.). However, one could increase the feed rate of air to the burner to a higher second feed rate (e.g., 8 units/minute) to reduce carbon monoxide in the burner gases if, for example: the feed rate was increased even more of volatile material and/or fluidizing medium to the riser 1; and/or a cooler volatile material and/or a cooler fluidizing medium (e.g., water) was introduced into the riser; and/or the feed rate was increased of cooling medium, introduced into the burner B; and/or a cooler cooling medium was introduced into the burner; and/or the feed rate was increased of heated contact material to the riser from the burner in order to cool the burner to its predetermined maximum temperature (e.g., 1400° F.) and the increased amount of air did not cause the carbon monoxide concentration in the burner gases to go below about 0.1% (preferably below about 2%).

In operation of the process, if the hydrocarbon feed stock becomes lighter, so that it contains smaller amounts of high Conradson Carbon components and/or metal-containing components, and thereby the combustible deposits from the feed stock decrease on the contact material, going from the contactor A to the burner B, the process can be controlled by maintaining: the first contact temperature (e.g., 930° F.) in the riser 1; the first feed rate of air (e.g., 7 units/minute) to the burner; and the predetermined maximum temperature (e.g., 1400° F.) in the burner—provided that the carbon monoxide concentration in the burner gases does not go below about 0.1% (preferably below about 2%). If the carbon monoxide in the burner gases goes below about 0.1% (preferably below about 2%), the feed rate of air to the burner through the second valve 47 could be reduced to a lower third feed rate (e.g., 6.5 units/minute). This would reduce the burner temperature to a lower second temperature (e.g., 1380° F.) and increase the carbon monoxide in the burner gases above about 0.1% (preferably above about 2%). However, in such a case, the first feed rate of air (e.g., 7 units/minute) to the burner would preferably be maintained, and the contact temperature in the riser preferably would be reduced to a lower third temperature (e.g., 925° F.) within the range of suitable minimum contact temperatures. The contact temperature could be lowered in accordance with my pending application Ser. No. 144,477 by decreasing the flow of heated contact material from the burner to the riser through the standpipe 2 and the first valve 42. Also, the feed rate of volatile material and/or the feed rate of fluidizing medium to the riser 1 could be reduced and/or a cooler volatile material and/or a cooler cooling medium (e.g., water) could be introduced into the riser. These measures could increase the combustible deposits on the contact material in the riser, going to the burner, and thereby increase the amount of carbon monoxide in the burner B above about 0.1% (preferably above about 2%) while maintaining the burner temperature at its predetermined maximum temperature (e.g., 1400° F.).

It will be understood that the embodiments shown and described herein are merely illustrative of the principles of my invention and that various modifications can be made by those skilled in the art without departing from the spirit and scope of the invention, the forms hereinbefore described being merely preferred embodiments. In this regard, it is contemplated that the first temperature controller 41, with its associated first valve 42, could be dispensed with altogether. In such a case, the contact temperature in the riser 1 of the contactor A would be a direct function of the temperature in the burner B. As a result, the temperature in the burner B would be kept as close as possible to its predetermined maximum (e.g., 1400° F.) by: varying the feed rate and temperature of the volatile material and the fluidizing medium introduced into the riser 1 of contactor A; varying the feed rate and temperature of the cooling medium introduced into the burner B; and varying the feed rate of oxidizing gas introduced into the burner through the second valve 47, so long as the flow of oxidizing gas into the burner provided less than the stoichiometic amount of oxidizing gas, required to oxidize completely the combustible deposits from the feed stock on the contact material, in accordance with this invention.

I claim:

1. In a process for decarbonizing, demetallizing and/or desalting a hydrocarbon feed stock by:

contacting, in a selective vaporization step, for a short hydrocarbon residence time of less than 3 seconds at an elevated contact temperature, the feed stock with an inert solid contact material in a confined rising vertical column to vaporize a major portion of the feed stock and to provide, as combustible deposits on the contact material, an unvaporized minor portion of the feed stock which includes high Conradson Carbon components and/or metal-containing components of the feed stock; separating the vaporized major portion of the feed stock from the contact material bearing the combustible deposits and quenching to arrest thermal cracking; contacting in a combusion step the contact material, bearing the combustible deposits, with an oxidizing gas to oxidize the combustible deposits and generate heat, whereby the contact material is heated by combustion of the combustible deposits; and recycling the so-heated contact material to contact further feed stock in the selective vaporization step, the improvement comprising:

contacting the contact material in the combustion step with less than the stoichiometric amount of oxidizing gas, required to oxidize completely the combustible deposits, so that oxidizable high Conradson Carbon and/or metal-containing components of the combustible deposits are only partially oxidized to carbon monoxide and so that there is a reducing atmosphere in the combustion step.

2. The process of claim 1 wherein the reducing atmosphere in the combustion step comprises about 0.1 to 10% by volume carbon monoxide.

3. The process of claim 1 wherein the reducing atmosphere in the combustion step comprises about 2 to 8% by volume carbon monoxide.

4. The process of claim 1 wherein the contact material comprises a high metal content solid.

5. The process of claim 4 wherein the contact material comprises microspheres of kaolin clay containing about 2 to 9% $Fe_2O_3$.

6. The process of claim 1 which further comprises maintaining the temperature of the combustion step at a predetermined maximum by varying the feed rate and/or the temperature of a volatile material which is added to the feed stock in the selective vaporization step.

7. The process of claim 6 wherein the volatile material comprises steam, water or a hydrocarbon which can decrease the partial pressure of hydrocarbons in the feed stock.

8. The process of claim 1 which further comprises maintaining the temperature of the combustion step at a predetermined maximum by varying the feed rate and/or the temperature of a fluidizing medium which is added to the contact material in the selective vaporization step before the contact material contacts the feed stock and which serves to transport the contact material up the confined rising vertical column.

9. The process of claim 8 wherein the fluidizing medium comprises steam or water.

10. The process of claim 1 which further comprises maintaining the temperature of the combustion step at a predetermined maximum by varying the feed rate and/or the temperature of a cooling medium which is added to the contact material in the combustion step.

11. The process of claim 10 wherein the cooling medium comprises steam or water.

12. The process of claim 1 wherein carbonaceous deposits are formed on the contact material in the selective vaporization step and at least a portion of the carbonaceous deposits is maintained on the surface of the contact material during the combustion step and when the contact material is recycled to the selective vaporization step.

13. The process of claim 12 wherein the carbonaceous deposits, maintained on the surface of the contact material, comprise about 0.05% by weight or more of the contact material.

14. The process of claim 13 wherein the carbonaceous deposits, maintained on the contact material, comprise about 0.1–5% of the contact material.

15. In a process for decarbonizing, demetallizing and/or desalting a hydrocarbon feed stock by:

contacting, in a selective vaporization step, for a short hydrocarbon residence time of less than 3 seconds at an elevated contact temperature, the feed stock with an inert solid contact material in a confined rising vertical column to vaporize a major portion of the feed stock and to provide, as combustible deposits on the contact material, an unvaporized minor portion of the feed stock which includes high Conradson Carbon components and- /or metal-containing components of the feed stock; separating the vaporized major portion of the feed stock from the contact material bearing the combustible deposits and quenching to arrest thermal cracking; contacting in a combustion step the contact material, bearing the combustible deposits, with an oxidizing gas to oxidize the combustible deposits and generate heat, whereby the contact material is heated by combustion of the combustible deposits; and recycling the so-heated contact material to contact further feed stock in the selective vaporization step, the improvement comprising:

contacting the contact material in the combustion step with less than the stoichiometric amount of oxidizing gas, required to oxidize completely the combustible deposits, so that oxidizable high Conradson Carbon and/or metal-containing components of the combustible deposits are only partially oxidized to carbon monoxide and so that there is a reducing atmosphere in the combustion step, and maintaining the temperature of the combustion step at a predetermined maximum by increasing or decreasing the contact temperature in the selective vaporization step within a range of preferred temperatures for vaporizing most of the feed stock but not the majority of its high Conradson Carbon components or its metal-containing components in order to respectively decrease or increase the unvaporized minor portion of the feedstock, deposited on the contact material.

16. The process of claim 15 wherein the reducing atmosphere in the combustion step comprises about 0.1 to 10% by volume carbon monoxide.

17. The process of claim 15 wherein the reducing atmosphere in the combustion step comprises about 2 to 8% by volume carbon monoxide.

18. The process of claim 15 which further comprises increasing the contact temperature in the selective vaporization step by increasing the recycle of heated contact material in order to decrease the temperature of the combustion step to its predetermined maximum when the reducing atmosphere in the combustion step contains more than about 8% carbon monoxide.

19. The process of claim 15 which further comprises decreasing the contact temperature in the selective vaporization step by decreasing the recycle of heated contact material in order to increase the temperature of the combustion step to its predetermined maximum when the reducing atmosphere in the combustion step contains less than about 2% carbon monoxide.

20. The process of claim 15 wherein the contact material comprises a high metal content solid.

21. The process of claim 20 wherein the contact material comprises microspheres of kaolin clay containing about 2 to 9% $Fe_2O_3$.

22. The process of claim 15 which further comprises maintaining the temperature of the combustion step at a predetermined maximum by varying the feed rate and/or the temperature of a volatile material which is added to the feed stock in the selective vaporization step.

23. The process of claim 22 wherein the volatile material comprises steam, water or a hydrocarbon which can decrease the partial pressure of hydrocarbons in the feed stock.

24. The process of claim 15 which further comprises maintaining the temperature of the combustion step at a predetermined maximum by varying the feed rate and/or the temperature of a fluidizing medium which is added to the contact material in the selective vaporization step before the contact material contacts the feed stock and which serves to transport the contact material up the confined rising vertical column.

25. The process of claim 24 wherein the fluidizing medium comprises steam or water.

26. The process of claim 15 which further comprises maintaining the temperature of the combustion step at a predetermined maximum by varying the feed rate and/or the temperature of a cooling medium which is added to the contact material in the combustion step.

27. The process of claim 26 wherein the cooling medium comprises steam or water.

28. The process of claim 15 wherein carbonaceous deposits are formed on the contact material in the selective vaporization step and at least a portion of the carbonaceous deposits is maintained on the surface of the contact material during the combustion step and when the contact material is recycled to the selective vaporization step.

29. The process of claim 28 wherein the carbonaceous deposits, maintained on the surface of the contact material, comprise about 0.05% by weight or more of the contact material.

30. The process of claim 29 wherein the carbonaceous deposits, maintained on the contact material, comprise about 0.1–5% of the contact material.

* * * * *

UNITED STATES PATENT OFFICE
CERTIFICATE OF CORRECTION

PATENT NO. : 4,374,021

DATED : February 15, 1983

INVENTOR(S) : David B. Bartholic

It is certified that error appears in the above-identified patent and that said Letters Patent are hereby corrected as shown below:

Column 1 - line 51 should read -- ing demands. The FCC process was adapted to pro- --.

Column 4 - line 40 should read -- caused the contact material to be degraded during processes --.

Signed and Sealed this

*Twenty-sixth* Day of *April 1983*

[SEAL]

*Attest:*

GERALD J. MOSSINGHOFF

*Attesting Officer*

*Commissioner of Patents and Trademarks*